United States Patent [19]

Shaffer et al.

[11] 4,089,707

[45] May 16, 1978

[54] METHOD OF IMPROVING CORROSION RESISTANCE OF LEAD AND LEAD ALLOY COATED METAL

[75] Inventors: Robert J. Shaffer, Richfield; Vernon J. Schwering, Parma, both of Ohio

[73] Assignee: Republic Steel Corporation, Cleveland, Ohio

[21] Appl. No.: 706,776

[22] Filed: Jul. 19, 1976

[51] Int. Cl.[2] ..... C23F 7/00

[52] U.S. Cl. ..... 148/6.14 R; 106/14.21; 148/6.15 R; 427/343

[58] Field of Search ..... 148/6.15 R, 6.14 R, 148/6.14 A, 6; 427/343; 204/35 R, 36, 37 R, 37 T, 43 S; 134/41; 106/14

[56] References Cited

U.S. PATENT DOCUMENTS

| | | | |
|---|---|---|---|
| 2,327,885 | 8/1943 | Grace et al. | 204/35 R |
| 2,438,013 | 3/1948 | Tanner | 204/35 R X |
| 3,879,231 | 4/1975 | Watanabe et al. | 148/6.15 R |

OTHER PUBLICATIONS

Field et al., The Chemical Coloring of Metals, D. Van Nostrand Co., 1926, p. 72.

Fishlock, Metal Colouring, Robert Draper Ltd., 1962, pp. 296, 297.

*Primary Examiner*—Ralph S. Kendall

*Attorney, Agent, or Firm*—Watts, Hoffmann, Fisher & Heinke Co.

[57] ABSTRACT

A method of improving the corrosion resistance of a lead or lead alloy coated metal characterized by the step of treating the surface of the coated metal with hydrochloric acid.

2 Claims, No Drawings

METHOD OF IMPROVING CORROSION RESISTANCE OF LEAD AND LEAD ALLOY COATED METAL

BACKGROUND OF THE INVENTION

The present invention relates generally to lead coated metals, and more specifically to a method of improving the corrosion resistance of lead and lead alloy coated metals, especially terne coated steel.

A conventional procedure of applying terne metal and the like generally includes the steps of alkaline cleaning, acid pickling, rinsing, applying a flux such as mixtures of zinc and ammonium chlorides to the metal substrate, coating the substrate with terne metal, and then applying palm oil or the like. In instances where a second layer of terne metal is to be applied, it has been proposed to quench the product between the two immersions with a pickling solution or with a flux solution to render the surface receptive to the second coating. Conventional practices also include applying supplemental surface treatments such as chromating, oxalating, sulphating and phosphating to lead coated articles. It has been suggested that under proper conditions the lead may be bright-flowed to further enhance its corrosion retarding ability.

Even with the best practices and control of processing variables, defects, especially pinholes and the like, occur in the lead coatings so as to cause the products to be rejected. Although both lead and tin are corrosion resistant, they are cathodic to iron under most conditions so that the terne metal will accelerate corrosion of the steel substrate if any portion of the steel is exposed, as by the occurrence of pinholes. Heretofore, it has been the practice to increase the terne metal thickness for applications in which corrosion resistance is a requirement, since thicker coatings have less of a tendency to form pinholes. The use of heavily coated ternes adds to the cost of the product.

SUMMARY OF THE INVENTION

It has now been found that the corrosion resistance of lead and lead alloy coated metal, such as terne and the like, can be unexpectedly improved by treating the lead surface with acid. As hereinafter described in examples of the preferred embodiments, excellent results are obtained using hydrochloric acid.

Accordingly, the present invention provides a method of improving the corrosion resistance of lead and lead alloy coated metal comprising treating the surface of the coated metal with hydrochloric acid.

More particularly, the invention provides a method of improving the corrosion resistance of lead and lead alloy coated steel comprising the steps of applying hydrochloric acid to the surface of the coated metal and thereafter rinsing the surface.

The method of application can be similar to that of metal cleaners or metal treatment chemicals. Spray, dip immersion, roll immersion, brushing, flowing and roll application are suitable techniques for both continuous processing and batch application of the acid. While the process of the invention is specifically directed to lead or lead alloy coated ferrous and nonferrous metal, it is to be understood that the term lead alloy includes normal alloying constituents such as tin, antimony, arsenic, zinc, calcium, etc., as well as the usual refinery process impurities in lead.

Additional advantages and a fuller understanding of the invention will be had from the following detailed description.

DESCRIPTION OF PREFERRED EMBODIMENTS

The following Table I sets forth the results of subjecting a number of steel specimens coated with various lead alloy coating compositions to salt spray corrosion and porosity tests. In each of the nine examples listed in Table I, specimens were provided with an acid surface treatment in accordance with the invention and were tested in comparison to identical specimens which were not given an acid treatment. The specific coating compositions for the specimens in each example are given in Table II.

The salt spray tests were conducted in accordance with the requirements specified in ASTM B117-64 except that testing was limited to seven hours of exposure during each 24-hour period. The measurements of pores per square inch were obtained by a porosity test in which the specimens were immersed for six hours in distilled water maintained at 200° ± 5° F. The pore count was then determined by visually counting the red rust spots within the one square inch of surface having the maximum density of pores.

TABLE I

| Example | Basic coating material | Salt Spray Corrosion Resistance Average hours to 10% Red Rust | | Porosity Average pores per square inch | |
|---|---|---|---|---|---|
| | | Regular | Acid Treatment | Regular | Acid Treatment |
| 1 | Pb-Sn | 21 | 500(1) | 7 | 0 |
| 2 | Pb-Sn | 21 | 500(1) | 48 | 1 |
| 3 | Pb-Sn | 14 | 500(1) | 32 | 5 |
| 4 | Pb-Sn | 14 | 449 | 40 | 0 |
| 5 | Pb-Sn | 7 | 16 | 28 | 0 |
| 6 | Pb-Sn-Zn | 7 | 266 | 100 | 0 |
| 7 | Pb-Sn-Zn | 78 | 137 | 5 | 0 |
| 8 | Pb-Sn | 24(2) | 73 | 23 | 0 |
| 9 | Pb-Sn | 24(2) | 115 | 4 | 0 |

(1)Test discontinued at 500 hours — coatings had not achieved 10% red rust
(2)Significantly more than 10% red rust at 24 hours of exposure

TABLE II

| Ex. | Coating Composition |
|---|---|
| 1 | 12% Tin - Balance Lead Plus Incidental Impurities |
| 2 | 10.5% Tin - Balance Lead Plus Incidental Impurities |
| 3 | 7.8% Tin - Balance Lead Plus Incidental Impurities |
| 4 | 5.9% Tin - Balance Lead Plus Incidental Impurities |
| 5 | 4.0% Tin - Balance Lead Plus Incidental Impurities |
| 6 | 2.0% Tin - 0.01% Zinc - Balance Lead Plus Incidental Impurities |
| 7 | 6.0% Tin - 0.22% Zinc - Balance Lead Plus Incidental Impurities |
| 8 | Nominal 12% Tin - <0.05% Antimony - Balance Lead Plus Incidental Impurities |
| 9 | Nominal 12% Tin - < 0.05% Antimony - Balance Lead Plus Incidental Impurities |

It will be seen from Table I that in each instance the application of an acid treatment to the lead alloy coating resulted in a significant improvement in corrosion resistance. At the same time, the acid treatment substantially eliminated any porosity of the coatings.

Table III shows the results of salt spray corrosion tests in which lead alloy coated steel specimens were treated with different concentrations of hydrochloric acid, as well as with different acids.

TABLE III

| Example | Type of Treatment | Salt Spray Hours to 10% Red Rust ± Confidence Limits | Comments |
|---|---|---|---|
| 10 A | Untreated | 7 ± 0 | Production terne sample |
| B | 1% HCl | 53 ± 7 | Vapor degreased |
| C | 5% HCl | 49 ± 0 | Acetone scrubbed |
| D | 10% HCl | 52 ± 4 | Acetone Dip |
| E | 20% HCl | 50 ± 4 | Xylol/alcohol dip |
| F | 30% HCl | 52 ± 4 | Six-second immersion treatment |
| G | 40% HCl | 53 ± 11 | Cold water rinse |
| H | 50% HCl | 55 ± 7 | |
| 11 A | Untreated | 7 ± 0 | |
| B | 50% Phosphoric Acid | 14 ± 0 | |
| C | 25% HCl | 84 ± 0 | Production terne sample |
| D | 50% Acetic Acid (12 seconds) | 18 ± 4 | Vapor degreased |
| E | 50% Sulfuric Acid | 7 ± 0 | Six-second immersion treatment |
| F | 50% HCl | 63 ± 7 | |
| 12 A | Untreated | 7 ± 0 | |
| B | ½% Nitric Acid | 11 ± 4 | Production terne sample |
| C | 2½% Nitric Acid | 32 ± 4 | Vapor degreased |
| D | 5% Ammonium Persulfate | 7 ± 0 | Six-second immersion treatment |
| E | 50% HCl | 63 ± 0 | |

The invention is not limited to particular techniques of applying the acid or to limitations of exposure time, acid temperature and concentration, etc. Good results are obtained using any common practice of surface treatment application, including spraying, immersion, brushing, flow coating and the like, at any convenient temperature. The process of the invention is effective within the normal limitations imposed by the properties of the materials involved, and requires only that the acid come into brief physical contact with the lead or lead alloy coating, typically for one to fifteen seconds, prior to rinsing. Longer treatment times have no further beneficial effects.

Many modifications and variations of the invention will be apparent to those skilled in the art in view of the foregoing. Therefore, it is to be understood that, within the scope of the appended claims, the invention can be practiced otherwise than as specifically disclosed.

What is claimed:

1. A method of improving the corrosion resistance of steel coated with lead or lead alloy consisting of the steps of treating the surface of the coated steel with an aqueous solution consisting essentially of water and hydrochloric acid.

2. A method of improving the corrosion resistance of steel coated with lead or lead alloy consisting essentially of the steps of applying an aqueous solution consisting essentially of water and hydrochloric acid to the surface of the coated steel and thereafter rinsing the surface.

* * * * *